United States Patent [19]

Puresevic et al.

[11] Patent Number: 4,523,688

[45] Date of Patent: Jun. 18, 1985

[54] CHILD-PROOF CLOSURE FOR A CONTAINER

[76] Inventors: Peter J. Puresevic, 6 Neyland Close, Tonteg, Mid Glamorgan CF38 IHH; Julian D. Taylor, 3 St. Teilo's Way, Watford Farm Estate, Caerphilly, Mid Glamorgan CF8 1EA, both of Wales

[21] Appl. No.: 384,559

[22] Filed: Jun. 3, 1982

[30] Foreign Application Priority Data

Jun. 4, 1981 [GB] United Kingdom ..... 8117100

[51] Int. Cl.[3] ..... B65D 55/02

[52] U.S. Cl. ..... 215/220

[58] Field of Search ..... 215/219, 220

[56] References Cited

U.S. PATENT DOCUMENTS

| | | | |
|---|---|---|---|
| 3,776,407 | 12/1973 | Cistone | 215/220 |
| 3,843,006 | 10/1974 | Naito et al. | 215/220 |
| 3,912,101 | 10/1975 | Rayner et al. | 215/220 |
| 4,319,690 | 3/1982 | Birrell et al. | 215/220 |

*Primary Examiner*—George T. Hall

*Attorney, Agent, or Firm*—George A. Rolston

[57] ABSTRACT

A closure device for a container such as a medicine bottle having inner and outer caps, biassed axially apart, each cap comprising respectively an end member and a skirt member, there being a first drive between the skirt members and a second drive between the end members.

9 Claims, 17 Drawing Figures

CHILD-PROOF CLOSURE FOR A CONTAINER

TECHNICAL FIELD OF THE INVENTION

The invention relates to a closure device for a container having a cylindrical opening.

BACKGROUND ART

Generally closure devices such as screw-threaded caps of containers with a screw-threaded opening such as a neck can be removed relatively easily by unscrewing. This can be dangerous when the container houses drugs, dangerous chemicals and the like and a child for example unscrews the closure device and gains access to the contents and then takes the contents with possibly harmful or even fatal results.

Closure devices which seek to provide for safer or authorised opening of the container has been proposed, but they are generally complex and expensive.

DISCLOSURE OF THE INVENTION

It is an object of the invention to seek to mitigate these disadvantages of prior closures for containers.

According to the invention there is provided a closure device for a container having a cylindrical opening, comprising inner and outer closure members each comprising an end member and skirt member, and first and second drive means, the first drive means being between the respective skirt members and being operative to rotate the closure members in unison in one sense only, the second drive means being associated with means biassing the inner and outer members axially apart and being operative to rotate the closure members in unison in the opposite sense only when pressure is applied to the outer member in the axial direction sufficiently to overcome the pressure of the biassing means to move the outer member towards the inner member and the outer member is rotated in the opposite sense.

Using the invention it is possible to provide a closure device which can be screwed or unscrewed easily and positively onto or from a container yet provides a safety closure as it cannot readily be removed by an unauthorised person. The closure members are preferably cylindrical.

The first drive means may comprise a driving dog on one skirt member and a ratchet on the facing wall of the other skirt member. This construction is relatively simple yet provides a positive action to mount the closure device on the container and allows the outer cylindrical closure member to rotate relative to the inner cylindrical member, the ratchet clicking over the dog, if the force of the biassing means is not overcome, so preventing removal of the closure device from the container.

The driving dog may preferably be on the inner surface of the outer skirt member and the ratchet may be on the outer surface of the inner skirt member. This construction provides for a positive driving action in the one sense when the closure device is being tightened on the container.

There may be a plurality of spaced apart driving dogs and ratchets. This construction spreads the lightening force around the skirt members so that there is no localised application of force which might lead to failure at a particular point.

The second drive means may comprise a socket of one end member and a projection of the other end member, and the biassing means may comprise a resilient member carried by one end member and contacting the adjacent surface of the other end member. This construction is again a relatively simple one to manufacture and it provides a relatively simple yet efficient way of ensuring a positive turning in the opposite (unscrewing) sense.

There may preferably be a plurality of projections and a plurality of sockets. This construction provides for positive driving engagement without the requirement for a large wrist movement before turning in the opposite sense is effected.

There may be two projections and eight sockets. This arrangement provides for a relatively rapid engagement of the second driving means on pushing and turning of the outer cylindrical closure member.

Each projection may be on the inner surface of the end member of the outer cylindrical member and each socket may be carried by the outer surface of the end member of the inner cylindrical closure member. This construction provides for a positive spigot and socket kind of engagement when the pressure of the resilient member is overcome.

The resilient member may be a ring integral with and projecting from the inner surface of the member of the outer cylindrical closure member. This construction is relatively easy and inexpensive to manufacture, particularly when the inner and outer cylindrical closure members are made of plastics, suitable by injection moulding.

It will be understood that the invention extends to a container having a screw-threaded cylindrical opening and a closure device as hereinbefore defined in which the inner surface of the skirt of the inner cylindrical closure member has a screw thread which mates, or can mate, with the screw-threaded cylindrical opening.

Two safety closure devices for the externally screw-threaded neck of a bottle are hereinafter described, by way of example, with reference to the accompanying drawings.

Figure 1:
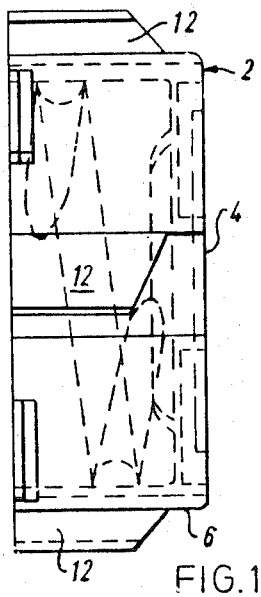
FIG. 1 is a side elevational view of an inner cylindrical closure member of a first closure device.
Figure 2:
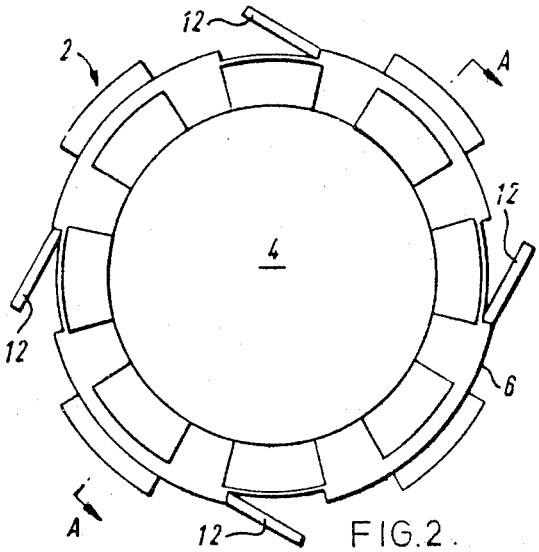
FIG. 2 is a plan view of the closure member of FIG. 1.
Figure 3:
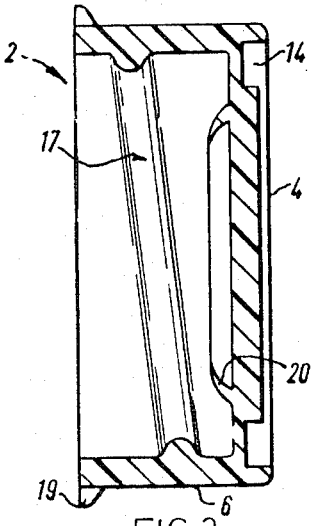
FIG. 3 is a sectional view of the line A—A of FIG. 2.
Figure 4:
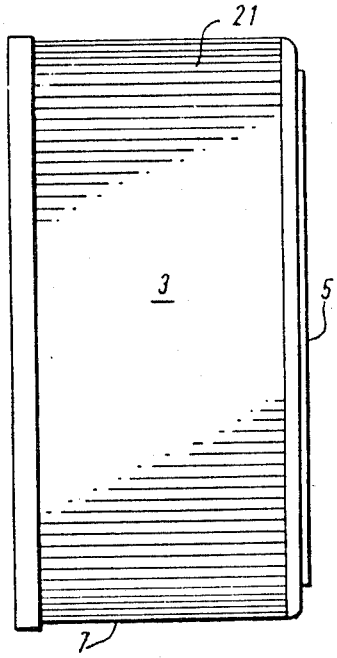
FIG. 4 is a side elevational view of an outer cylindrical closure member of the first closure device.
Figure 5:
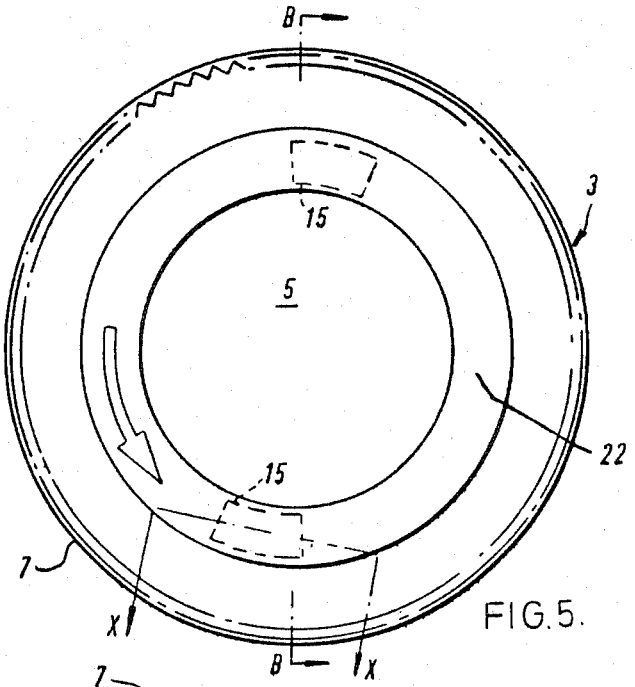
FIG. 5 is a plan view of the closure member of FIG. 4.
Figure 6:
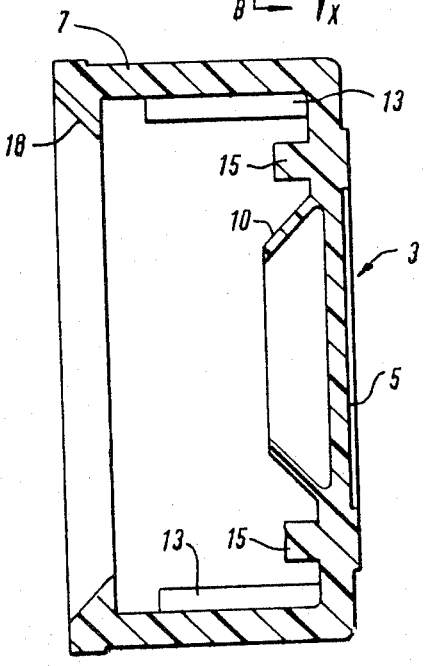
FIG. 6 is a sectional view on the line B—B of FIG. 5.

Referring firstly to FIGS. 1 to 8 of the drawings, the closure device 1 shown comprises inner and outer cylindrical closure members 2 and 3 each comprising respectively an end member 4 and 5 and a skirt member 6 and 7 and first and second drive means 8 and 9, the first drive means 8 being between the skirt members 6 and 7, the second drive means 9 being associated with biassing means in the form of a resilient member or ring 10 which biasses the inner and outer members 2 and 3 axially apart.

The inner cylindrical closure member or cap 2 is smaller on its outer diameter than the inner diameter of the outer cylindrical closure member or cap 3, so there is a gap 11 between the two caps in which the first drive means 8 is situated. The first drive means 8 for turning the two caps 2 and 3 in unison in one sense to tighten the closure device 1 on the neck (not shown) comprises four equally circumferentially spaced apart ratchets 12 on the outer (as viewed) surface of the skirt 6 and four driving dogs 13 equidistantly circumferentially spaced apart on the inner (as viewed) surface of the skirt 7.

The second drive means 9 comprises eight equidistantly spaced apart sockets 14 carried by the outer surface of the end member 4 of the cap 2 and two diametrically opposed dogs 15 which are of generally triangular section with a flat 16 and which project from the inner surface of the end member 5 of the outer cylindrical cap 3.

The ring 10 is of less diameter than the diametrical spacing of the drive dogs 15 and has greater height than those dogs 15 so that the inner and outer caps 2 and 3 are spaced apart with the drive dogs 15 out of engagement with the sockets 14.

Both caps 2 and 3 are injection moulded as a separate integral unit, the inner surface of the skirt 6 having a screw thread 17 formed thereon during moulding. Polypropylene is the preferred plastics.

Figure 8:
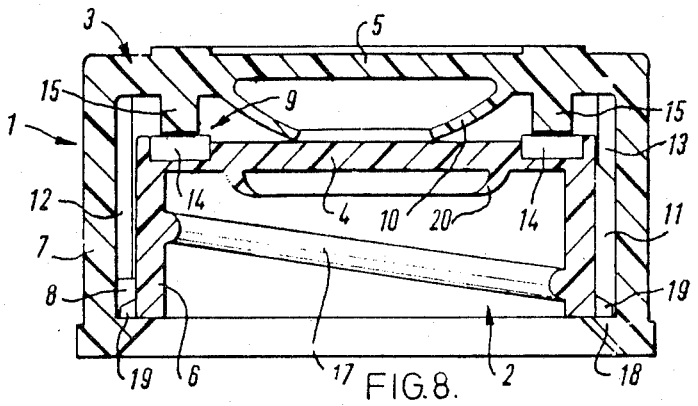
FIG. 8 is a transverse sectional view of the assembled closure device.
Figure 7:
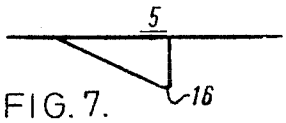
FIG. 7 is a scrap section on the line X—X of FIG. 5.
Figure 9:
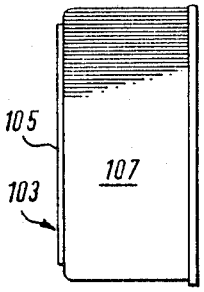
FIGS. 9,10,11 and 12 are respectively side elevational, top plan, bottom plan and transverse sectional views of an outer cylindrical closure member of a second safety closure device.
Figure 10:
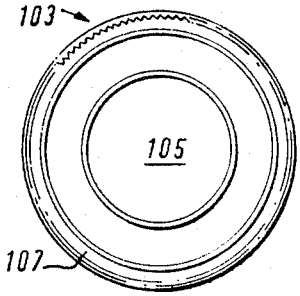
Figure 11:
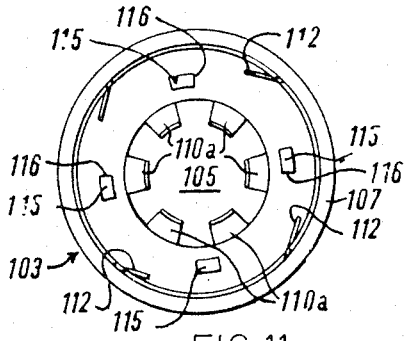

The two caps 2 and 3 are force-fitted together so that they assume the assembled condition shown in FIG. 8. The inner cap springs past a circumferential lip 18 on the outer cap 3 on assembly and anti-removal means in the form of four detents 19 on the inner cap 2 prevent it from springing out of the outer cap 3 past the lip 18 after assembly.

In order to tighten the closure device 1 on the screw-threaded neck of a bottle such as a medicine bottle, the closure device is offered up to the neck and the screw threads engage when the outer cap 3 is turned in one sense, clockwise, to effect tightening. This turning causes the drive dogs 13 to engage the free edges of the ratchets 12 so that both inner and outer caps 2 and 3 turn in unison in the tightening direction.

If the outer cap 3 is now rotated in the opposite sense, in the anti-clockwise or tightening direction, the drive dogs 13 merely click over the ratchets 12, which are resilient. The closure device 1 remains firmly in place on the neck. In order to remove the closure device 1 from the neck, it is necessary to depress the outer cap 3 axially so that the pressure of the ring 10 urging the caps 2 and 3 apart is overcome, the depression being sufficient to engage the drive dogs 15 in the sockets 14. On turning the outer cap 3 the inner cap 2 now turns with it so the two can be rotated in unison and removed from the neck. When removed the resilient ring 10 urges the two caps 2 and 3 axially apart again so that the drive dogs 15 and sockets 14 disengage, ready for re-assembly of the closure device 1 with the neck as described.

It will be understood that the invention above described and shown in FIGS. 1-8 may be modified. For example there may be more ratchets 12 and dogs 13, or fewer ratchets 12 and dogs 13, than the four shown. Also, there may be only one drive dog 15, or more than two drive dogs 15 and there may be more or fewer sockets 14 than the eight shown. Also, the sockets 14 may have chamfered lead-in edges to provide for as rapid and as easy location of the drive dogs thereon as possible. Also, the biassing means may comprise a separate spring means or resilient body rather than the integral ring 10 shown.

The inner cap 2 is shown as having an integral sealing ring 20 for sealing with the opening of the neck when the closure device is tightened on the neck. The inner cap 2 may however be formed without this feature. Also, the outer cap is shown with serrations 21 on the outer surface of the skirt 7 to assist in manipulation and with a legend 22 giving operating instructions. Either or both of these may be omitted or modified.

Figure 12:
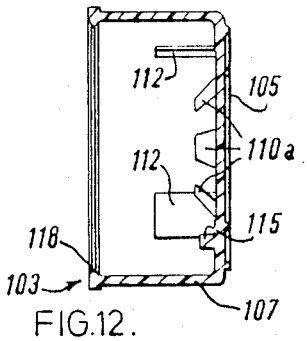
Figure 13:
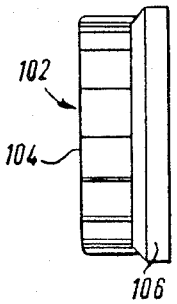
FIGS. 13,14,15 and 16 are respectively side elevational, top plan, bottom plan and transverse sectional views of an cylindrical closure member of a second safety closure device.
Figure 14:
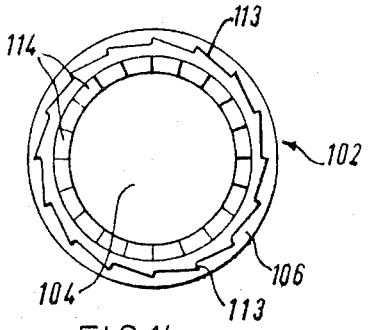
Figure 15:
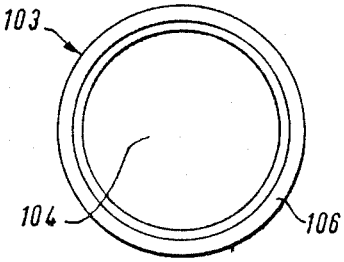
Figure 16:
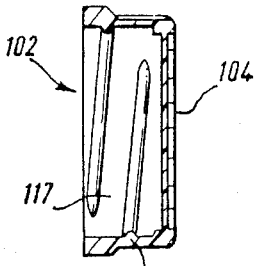
Figure 17:
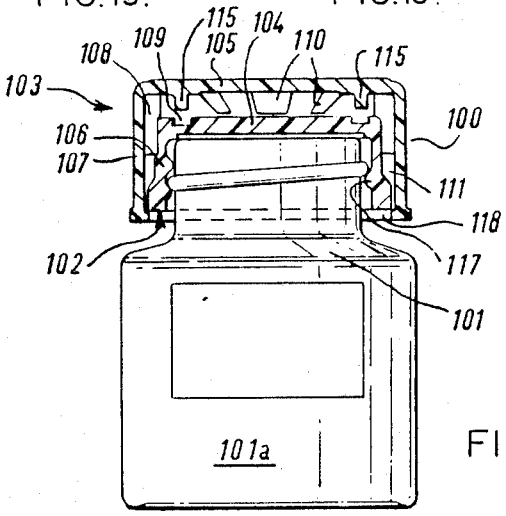
FIG. 17 shows a transverse sectional view of the assembled second safety closure device mounted on the externally screw-threaded neck of a bottle for containing potentially hazardous substances such as drugs.

Referring now to FIGS. 9-17, the closure device 100 (FIG. 17) shown comprises inner and outer cylindrical closure members 102 and 103 each comprising respectively an end member 104 and 105 a skirt member 106 and 107 and first and second drive means 108 and 109, the first drive means 108 being between the skirt members 106 and 107, the second drive means 109 being associated with biassing means in the form of a resilient member or ring 110 which is split into six circumferentially spaced segments **110*a* (of which three are shown in FIGS. 12 and 17) and which biasses the inner and outer members 102 and 103** axially apart.

The inner cylindrical closure member or cap 102 is smaller on its outer diameter than the inner diameter of the outer cylindrical closure member or cap 103, so there is a gap 111 between the the caps in which the first drive means 108 is situated. The first drive means 8 for turning the two caps 102 and 103 in unison in one sense to tighten the closure device 100 on the externally screw-threded neck 101 of the container **101*a* comprises four equally circumferentially spaced apart drive dogs 112 on the inner (as viewed) surface of the skirt 107 and ratchets 113 equidistantly circumferentially spaced apart on the outer (as viewed) surface of the skirt 106**.

The second drive means 109 comprises equidistantly spaced apart sockets 114 carried by the outer surface of the end member 104 of the cap 102 and four diametrically opposed dogs 115 which are of generally triangular section with a flat 116 like the flat 16 of the first and which project from the inner surface of the end member 105 of the outer cylindrical cap 103.

The segments **110*a* are on a circumference of less diameter than the diametrical spacing of the drive dogs 115 and have greater height than those dogs 115 so that the inner and outer caps 102 and 103 are spaced apart with the drive dogs 115 out of engagement with the sockets 114** which are themselves defined by walls which are inclined to the vertical on one side.

Both caps 102 and 103 are injection moulded as a separate integral unit, the inner surface of the skirt 106 having a screw thread 117 formed thereon during moulding. Polypropylene is the preferred plastics.

The two caps 102 and 103 are force-fitted together so that they assume the assembled conditions shown in FIG. 17. The inner cap springs past a circumferential lip 118 on the outer cap 103 on assembly.

In order to tighten the closure device 100 of the screw-threaded neck 101 of the bottle **101*a* such as a medicine bottle, the closure device 100 is offered up to the neck and the screw threads 117 engage when the outer cap 103 is turned in one sense, clockwise, to effect tightening. This turning causes the drive dogs 112 to engage the free edges of the ratchets 113 so that both inner and outer caps 102 and 103** turn in unison in the tightening direction.

If the outer cap 103 is now rotated in the opposite sense, in the anti-clockwise or untightening direction, the drive dogs 112, which are flexible and resilient merely click over the ratchets 113 to produce an audible clicking sound. The closure device 100 remains firmly in place on the neck 101. In order to remove the closure device 100 from the neck 101, it is necessary to depress the outer cap 103 axially so that the pressure of the segments 110*a* urging the caps 102 and 103 apart is overcome, the depression being sufficient to engage the drive dogs 115 in the sockets 114. On turning the outer cap 103 the inner cap 102 now turns with it so the two can be rotated in unison and removed from the neck. When removed the resilient ring segments 110*a* urge the two caps 102 and 103 axially apart again so that the drive dogs 115 and sockets 114 disengage, ready for re-assembly of the closure device 100 with the neck as described.

It will be understood that the invention above described and shown in the drawings may be modified. For example there may be fewer or more ratchets 113 and dogs 112, than those shown. Also, there may be only one drive dog 115, or more than four drive dogs 115 and there may be more or fewer sockets 114 than those shown.

In all cases the sockets 114 have the inclined, or chamfered, lead-in edges to provide for as rapid and as easy location of the drive dogs therein as possible. Also, the biassing means may comprise a separate spring means or resilient body rather than the segments 110*a* shown.

The closure devices shown may be made to fit any standard container or bottle. No special container or bottle is required.

Both closure devices 1 and 100 are made by injection moulding and, because of the arrangement of the first and second drive means being separated so that one is between the skirts and the other is between the tops of the respective inner and outer closure members stripping of the formed members from the mould tools using a stripper plate to "knock" them off in an axial direction from the respective mould tool is relatively easy and rapid because it is not necessary to rotate the mould tools as it is in the prior art. This obviation of the rotational step in the moulding cycle saves 5–10 seconds per injection moulding "shot". Also the obviation of the need to rotate the mould tool in manufacture of a closure member embodying the the invention means that the requirement for a gear-box is obviated, whereas it is required in other machines. This provides for a cost saving on the injection moulding itself and, importantly, also provides that the mould tool itself can have more impressions which means that more closure members can be produced per injection moulding "shot" or cycle. The invention embodied in the closure devices shown and described thus provides a rapid production of an increased number of the devices per injection moulding cycle over the prior art. Thus the time per cycle be reduced to 15 sec. from 25 sec. for the prior art and the number of devices produced may be 20 devices to 12 devices in the prior art.

It will be understood that the expression "closure device" used herein includes within its scope a device such as a nut which is rotatably closed down on a spigot, stud or bolt as by screwing, for example the wheel hub nut of a motor vehicle. Unauthorised removal of a nut embodying the invention is thereby prevented or hindered.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A closure device for a container having a cylindrical opening, comprising solely;

an inner cylindrical closure member;

an outer cylindrical closure member;

the inner and outer cylindrical closure member each comprising an end member, a skirt member and first and second drive means;

means biassing the inner and outer closure members axially apart, and means retaining same against separation;

the first drive means being between the respective skirt members and being operative to rotate the inner and outer closure members in unison in one sense only, such first drive means comprising a driving dog on the inner surface of the skirt member of said outer closure member and a ratchet means on the outer surface of the skirt member of the inner closure member, and, the second drive means being associated with said means biassing the inner and outer members axially apart and being operative to rotate the first and second closure members in unison in the opposite sense only when pressure is applied to the outer member in the axial direction sufficiently to overcome the pressure of the biassing means to move the outer member towards the inner member and the outer member is rotated in the opposite sense, such second drive means comprising a socket of one closure end member and a projection of the other closure end member and wherein the biassing means comprises a resilient member carried by one of said end members and contacting the adjacent surface of the other end member.

2. A closure device as defined in claim 1, wherein the resilient member is a ring integral with and projecting from the inner surface of the end member of the outer closure member.

3. A closure device according to claim 1, wherein there are a plurality of projections and a plurality of sockets.

4. A closure device according to claim 3, wherein there are two projections and eight sockets.

5. A closure device according to claim 1, wherein the projection is on the inner surface of the end member of the outer closure member and the socket is carried by the outer surface of the end member of the inner closure member.

6. A closure device according to claim 2, wherein there are a plurality of such driving dogs, and a greater plurality of such ratchet means.

7. A closure device according to claim 1, wherein said driving dog comprises a flap member extending from said skirt, and being movable relative to said other skirt, to ride over said ratchet means when rotated in one direction, and engaging same when rotated in the other direction.

8. A closure device for a container having a cylindrical opening, comprising solely;

an inner cylindrical closure member;

an outer cylindrical closure member;

the inner and outer cylindrical closure member each comprising an end member, a skirt member and first and second drive means;

means biassing the inner and outer closure members axially apart, and means retaining same against separation;

the first drive means being between the respective skirt members and being operative to rotate the inner and outer closure members in unison in one sense only, such first drive means comprising at least one movable flap member swingably attached on the inner surface of the skirt member of said outer closure member and ratchet means on the outer surface of the skirt member of the inner closure member, said at least one flap member being movable relative to said skirt, of said inner closure member to ride over said ratchet means when rotated in one direction, and engaging same when rotated in the other direction, and, the second drive means being associated with said means biassing the inner and outer members axially apart and being operative to rotate the first and second closure members in unison in the opposite sense only when pressure is applied to the outer member in the axial direction sufficiently to overcome the pressure of the biassing means to move the outer member towards the inner member and the outer member is rotated in the opposite sense, such second drive means comprising a socket of one closure end member and a projection of the other closure end member and wherein the biassing means comprises a resilient member carried by one of said end members and contacting the adjacent surface of the other end member.

9. A closure device as claimed in claim 8 wherein there are a plurality of said ratchet means, and a plurality of said movable flap members.

* * * * *